United States Patent [19]

Latham

[11] 4,086,830

[45] May 2, 1978

[54] HYDRAULIC WRENCH

[76] Inventor: Raymond E. Latham, 231 Tamerlaine, Houston, Tex. 77024

[21] Appl. No.: 757,344

[22] Filed: Jan. 6, 1977

[51] Int. Cl.[2] ..... B25B 13/46

[52] U.S. Cl. ..... 81/57.39

[58] Field of Search ..... 81/57.39, 52.4 R

[56] References Cited

U.S. PATENT DOCUMENTS

| | | | |
|---|---|---|---|
| 1,970,179 | 8/1934 | Miller | 81/57.39 |
| 3,745,858 | 7/1973 | Biach | 81/57.39 |
| 3,930,776 | 1/1976 | Keller | 81/57.39 |

*Primary Examiner*—James L. Jones, Jr.
*Attorney, Agent, or Firm*—Bill B. Berryhill

[57] ABSTRACT

A hydraulic wrench comprising: an elongated body; a drive assembly mounted at one end of the body for rotating a socket member connected thereto; a hydraulic power member connected to the drive assembly and the body for rotating the drive assembly; and an elongated reaction member engageable with the body and extendable therefrom for engagement with any suitable fixed object to provide a reaction force for operation of the wrench.

5 Claims, 4 Drawing Figures

HYDRAULIC WRENCH

BACKGROUND OF THE INVENTION

1. Field of the Invention

The present invention pertains to wrenches. In particular, it pertains to hydraulic wrenches of the type normally referred to as hydraulic torque wrenches.

2. Brief Description of the Prior Art

There are many situations in industry where it is necessary to assert relatively large torques on nuts or similar threaded fasteners. For example, there are millions of flange type connections in use which are fastened by threaded studs and nuts. In the past, conventional hand wrenches have been used for this purpose. However, it is sometimes difficult for one or even two men to apply the necessary torque to some of these connections, even by using a "cheater" device for extending the leverage of the wrench.

Furthermore, the hand wrenches of the past are not completely safe. Particularly when a cheater device is used, a hand wrench may slip causing injury to the user. They may also be hazardous in potentially combustible areas such as are frequently found in refineries and chemical plants, due to the possibility of sparks being generated when a wrench or cheater device slips. Governmental regulations of today generally forbid such unsafe practices.

Even if enough force can be applied manually to tighten the threaded connection, there may be lack of uniformity in a connection involving several threaded fasteners, such as in a flange connection. In many of the high-pressure industrial applications of today, it is essential that all fasteners are uniformly tightened and placed under uniform tension.

Because of the drawbacks of manual wrench tightening, several powered wrench devices have been developed over the years, including impact wrenches, geared wrenches and hydraulic wrenches. One of the most satisfactory in applying the necessary torque and in controlling the amount of torque applied is the hydraulic torque wrench. Examples of such wrenches are those disclosed in U.S. Pat. Nos. 3,745,858 and 3,930,776.

A typical hydraulic torque wrench will include an elongated body on which is carried a drive assembly connected to a socket member for engaging and rotating a threaded nut. The drive assembly may include some sort of ratchet device for allowing rotation in one direction but preventing it in the opposite. The drive assembly may include a lever arm, to which one end of a hydraulic ram or power unit may be connected, the opposite end of the power unit being connected to the body. During the power stroke, the hydraulic ram will be extended, moving the lever arm of the drive assembly and rotating the socket connected thereto. On the return stroke of the hydraulic ram, the ratchet device permits lost motion, applying no torque to the nut, so that the drive assembly can be repositioned for continued application of torque during the next power stroke of the hydraulic ram.

To apply the necessary force during the power stroke of the hydraulic ram, it is necessary to restrain the fixed end of the ram. This is generally accomplished by providing a reaction surface on the wrench body for resting against a suitable fixed object. Many times, there is no fixed object directly contactable by the body of the wrench and even if there is, it may be undesirable to react against it. For example, the fixed object may be a thin wall pipe which could be damaged by the reaction force.

SUMMARY OF THE PRESENT INVENTION

One object of the present invention is to provide an alternate means of engaging a suitable fixed object to provide the necessary reaction force for operation of a hydraulic torque wrench. Another object is to provide means for engaging such a fixed object for reaction at some point other than in a direct contact line with the body of the hydraulic wrench. Still another object of the invention is to provide such a means which can be adjusted within predetermined limits to allow space flexibility for the use of such a wrench.

To accomplish the objects of the present invention, the wrench may comprise: an elongated body; a rotatable drive assembly mounted thereon to which a socket member may be connected; and a reciprocal hydraulic power member connected to the body member and the drive assembly for rotation of the drive assembly upon reciprocation of the power member in one direction. The wrench is also provided with an elongated reaction member engageable with the body member and having its axis substantially perpendicular to the axis of the body member and extendable therefrom for engagement with any suitable fixed object to provide the necessary reaction force for operation of the wrench.

Such an arrangement offers the large and closely controllable torques necessary for most fastener applications of today without the limitations and inflexibility of of hydraulic torque wrenches of the prior art. Many other objects and advantages of the invention will be apparent from a reading of the specification which follows in conjunction with the accompanying drawings.

DESCRIPTION OF PREFERRED EMBODIMENTS

Figure 1:
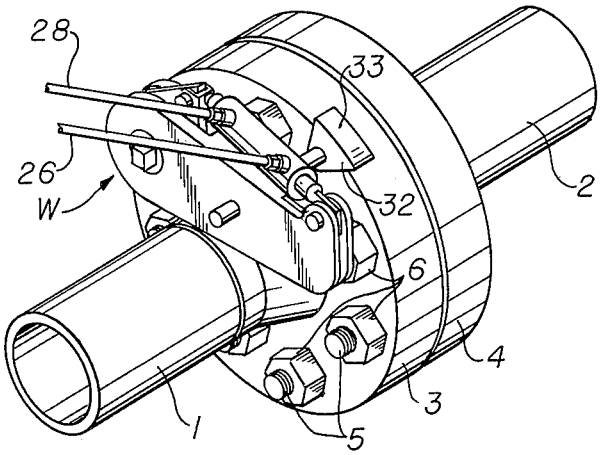
FIG. 1 is a perspective view of a torque wrench, according to a preferred embodiment of the invention, shown being used to tighten nuts of a flange connection.

Referring first to FIG. 1, there is shown a hydraulic torque wrench W, according to a preferred embodiment of the invention, being used to complete a flange type connection between conduits 1 and 2 to which flanges 3 and 4 are respectively welded. The flanges 3 and 4 are held together by a plurality of threaded studs 5 and nuts 6 near the periphery thereof.

Figure 2:
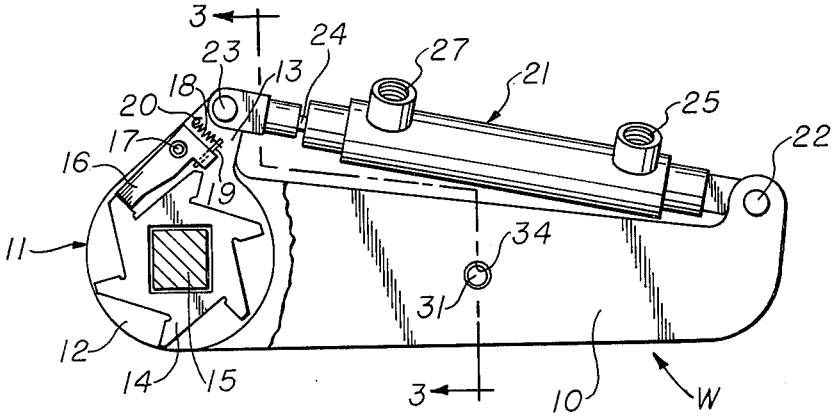
FIG. 2 is a side elevation view, partially broken away, illustrating a preferred embodiment of the torque wrench of the present invention.

Referring also to FIG. 2, the wrench W may comprise an elongated body member 10 on which is carried a drive assembly 11. Although many types of drive assemblies may be utilized, the one shown includes a circular plate 12, extending from which is a lever arm 13. The drive plate 12 and arm 13 may be mounted at one end of the body member 10 in any suitable manner for rotation about an axis perpendicular to the longitudinal axis of the body member 10.

Associated with the drive assembly 11 may be a latch or ratchet assembly which may include a sprocket or ratchet wheel 14 mounted for rotation about the same axis as drive plate 12, but capable of independent rotation relative thereto. Extending, preferably from both sides of the ratchet wheel 14 are hubs 15 which may be engaged by corresponding holes of a socket member (not shown) for engaging the desired fastener component, such as the nut 6 shown in FIG. 1. The ratchet assembly may also include a pawl member 16, pivotably attached to the drive assembly 11 by pin 17. The pawl member 16 is biased toward engagement with the teeth of the ratchet wheel 14, by a spring 18 attached to the pawl 16 by pin 19 and to the lever arm 13 by pin 20.

To power the wrench, a hydraulic ram 21 is connected at one end to the body member 10 by a pin 22 and at the opposite end to the lever arm 13 by a pin 23. The ram 21 is conventional and may be provided with a piston (not shown) to which is attached a rod 24. A hydraulic connection 25 may be provided for connection to a hydraulic hose, such as 26 in FIG. 1, which may in turn be connected to a suitable source of hydraulic power fluid. Upon supplying fluid under pressure to the one side of the piston, the rod 24 is extended, causing the lever arm 13 to move, rotating drive plate 12 and ratchet wheel 14. Since the rotation of the ratchet wheel 14 causes rotation of the hub 15 and any socket member which may be attached thereto, torque is then applied to the fastener member, such as nut 5, by which the socket member is engaged.

The hydraulic ram 21 may also be provided with another port 27 in fluid connection with the opposite side of the piston within the ram 21. In the case of a double-acting ram, a hydraulic hose 26 may be attached to this connection and extended to the hydraulic power source (not shown) to which the hydraulic hose 26 is connected. Suitable valving would be required for double operation.

In any event, some fluid (perhaps even air) may be introduced through connection 27 to return the piston and rod 24 to the contracted position. As this is done, the drive plate 12 would rotate in the opposite direction. However, the shape of the toothed ratchet wheel 14 would cam the pawl 16 away from the sprocket wheel, disengaging one tooth and reengaging an adjacent one upon complete retraction of the rod 13. During this movement, the ratchet wheel 14 and, of course, the hub 15 and attached socket member, would remain stationary. Very little power is required for the return stroke. Then the wrench would be in the position of FIG. 2 ready for recycling and another power stroke for applying torque to the fastener devices.

Figure 3:
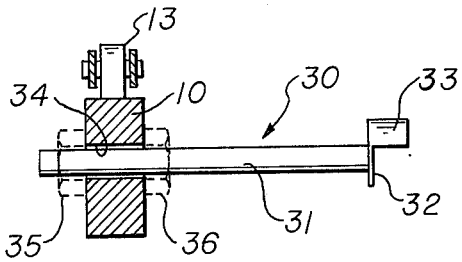
FIG. 3 is a cross-sectional view, taken along line 3—3 of FIG. 2, of the wrench of the present invention.
Figure 4:
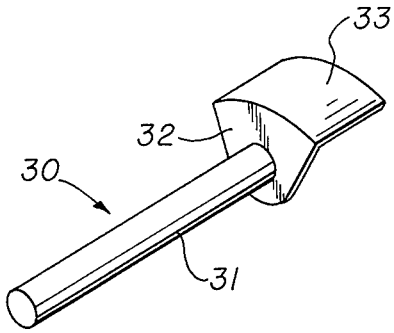
FIG. 4 is a perspective view of an elongated reaction member for use with the hydraulic wrench of the present invention.

As shown more fully in FIGS. 3 and 4, the wrench W of the present invention may be provided with an elongated reaction member 30 for providing the means of engaging a fixed object, spaced from the wrench, to provide the reaction force necessary for operation of the wrench. As illustrated, the reaction member comprises a cylindrical rod 31, to one end of which may be attached a plate 32 and a cylindrical or arcuate extension 33.

A hole 34 may be provided through the body 10 of the wrench for slidably receiving the cylindrical rod 31. Thus, the rod can be positioned at multiple locations for contacting the fixed object against which reaction forces will be taken. As shown in FIG. 1, the rod is extended so that the plate 32 and arcuate member 33, both of which may be referred to as a shoe, engages the edge of flange member 33, which will be the member against which reaction forces will be taken. Of course, the reaction member 30 may be reversed so that the shoe member extends to the left, rather than the right, as shown in FIG. 3. If desired, the rod 31 could be threaded and fixed in a particular position by lock nuts 35 and 36 (shown as dotted lines).

In operation, the socket member attached to the wrench W would be placed over the particular nut 6 to be tightened or loosened. The wrench would be so placed and the reaction member 30 so extended as to have the shoe 33 rest against the edge of flange 3. The wrench would be, for illustrative purposes, in its fully retracted position of FIG. 2. Then, hydraulic pressure would be applied to the ram 21, through connection 25, extending the rod 24 and rotating the drive assembly, ratchet wheel 14 and the attached socket member, applying torque to the nut. If the proper amount of torque is not reached in one stroke, the ram is returned and the power stroke repeated until pressure from suitable pressure indicators (not shown) show that the proper amount of torque has been reached.

Thus, as shown, the hydraulic wrench W of the present invention is provided with means of engaging a fixed object to provide reaction forces for operation of the wrench at locations laterally spaced therefrom (such as is the flange 3 in FIG. 1). This allows much greater flexibility of operation. Of course, the wrench W can be used without the reaction member 30 by simply resting the body 10 against a suitable fixed object adjacent thereto, where one is available.

Although a preferred embodiment of the invention has been described with several variations, many variations of the invention may be made by those skilled in the art without departing from the spirit of the invention. Therefore, it is intended that the scope of the invention be limited only by the claims which follow.

I claim:

1. A hydraulic wrench comprising: elongated body means having a hole therethrough the axis of which is substantially perpendicular to the axis of said body means; drive means rotatably mounted at one end of said body means; socket means connected to said drive means for rotation therewith; reciprocal hydraulic power means connected to said drive means and to the other end of said body means for rotating said drive means in one direction on movement in a first direction; latch means carried by said body means to prevent rotation of said socket means upon movement of said power means in a second direction; and an elongated rod member slidably receivable within said body means hole with its axis substantially perpendicular to the axis of said body means and extendable from either side of said body means at a plurality of locations for engagement with any suitable fixed object to provide reaction force for operation of said wrench.

2. A wrench as set forth in claim 1 in which at least one end of said rod member is provided with an enlarged surface for engagement with said fixed object.

3. A wrench as set forth in claim 2 in which said enlarged surface comprises an arcuate section for surface contact with the edges of a flange member or the like.

4. A wrench as set forth in claim 1 in which said rod member is threaded and provided with cooperating nuts for fixing said rod member at a selected one of said plurality of locations.

5. A wrench as set forth in claim 1 in which one end of said rod member is provided with a shoe member comprising a plate, whose surface is a plane perpendicular to the axis of said rod member, and an arcuate section attached to said plate for engaging a cylindrical surface of said fixed object.

* * * * *